US008771012B2

(12) United States Patent
Le Tortorec et al.

(10) Patent No.: US 8,771,012 B2
(45) Date of Patent: Jul. 8, 2014

(54) ANTENNA INTERFACE HAVING A SOCKET WITH TWO COAXIAL CABLES AND A MATING PLUG WITH TWO PISTON CONTACTORS SUPPORTED BY A FLEXIBLE MEMBRANE

(75) Inventors: Christian Le Tortorec, Cholet (FR); Xavier Retailleau, Cholet (FR); Mathieu Deffois, Cholet (FR); Anne Barbet, Burghausen (DE); Josef Gramsamer, Tittmoning (DE)

(73) Assignee: Thales, Neuilly sur Seine ( * ) Notice: Subject to any disclaimer, the term of this patent is extended or adjusted under 35 U.S.C. 154(b) by 38 days.

(21) Appl. No.: 13/699,274

(22) PCT Filed: May 20, 2011

(86) PCT No.: PCT/FR2011/051154

§ 371 (c)(1),
(2), (4) Date: Nov. 20, 2012

(87) PCT Pub. No.: WO2011/144881

PCT Pub. Date: Nov. 24, 2011

(65) Prior Publication Data

US 2013/0072058 A1 Mar. 21, 2013

(30) Foreign Application Priority Data

May 20, 2010 (FR) ..... 10 02131

(51) Int. Cl.
*H01R 9/05* (2006.01)

(52) U.S. Cl.
USPC ..... 439/584

(58) Field of Classification Search
CPC ..... H01R 9/05; H01R 9/0512; H01R 9/0515; H01R 9/0518; H01R 9/0521; H01R 9/0524; H01R 9/0527
See application file for complete search history.

(56) References Cited

U.S. PATENT DOCUMENTS

| | | | | |
|---|---|---|---|---|
| 3,805,216 | A * | 4/1974 | Gaspar et al. | 439/332 |
| 7,077,697 | B2 * | 7/2006 | Kooiman | 439/557 |
| 7,221,245 | B2 * | 5/2007 | Tanbakuchi et al. | 333/260 |
| 2010/0261381 | A1 * | 10/2010 | Montena et al. | 439/584 |
| 2010/0261382 | A1 * | 10/2010 | Montena et al. | 439/584 |

FOREIGN PATENT DOCUMENTS

| | | | |
|---|---|---|---|
| CN | 201113051 | Y | 9/2008 |
| GB | 2423649 | A | 8/2006 |
| JP | 2000196488 | A | 7/2000 |

* cited by examiner

*Primary Examiner* — Chandrika Prasad
(74) *Attorney, Agent, or Firm* — Davidson, Davidson & Kappel, LLC

(57) ABSTRACT

The present invention provides an antenna interface. The antenna interface includes a socket and a plug. The socket includes a body and two coaxial cables, each having a core, a braid coaxial to the core, and an electric insulator between the core and the braid. Each coaxial cable extends between a first end connected to a printed circuit board of the receiver and a second end at which the braid is electrically connected to the body, and at which the core can be accessed through an opening made in the body. The plug includes a body and at least two contactors such that, when the plug and the socket are connected, each contactor is arranged opposite an opening such that the core of a respective cable is electrically connected to the contactor, and the braid of each cable is electrically connected to the body of the plug via the body.

12 Claims, 4 Drawing Sheets

ANTENNA INTERFACE HAVING A SOCKET WITH TWO COAXIAL CABLES AND A MATING PLUG WITH TWO PISTON CONTACTORS SUPPORTED BY A FLEXIBLE MEMBRANE

The present invention relates to an antenna interface for a radio receiver.

BACKGROUND

Already known in the state of the art is an antenna interface for a radio receiver, of the type comprising a socket, designed to be connected to the receiver, and a plug, designed to be connected to the antenna.

Such interfaces are typically used for a single-band receiver, i.e. a receiver capable of transmitting and/or receiving on a single frequency band.

In the case of a dual-band receiver, i.e. a receiver capable of transmitting and/or receiving on two distinct frequency bands, it is necessary to provide two distinct interface sockets. However, the use of two sockets is relatively bulky, which is in particular detrimental to miniaturization of the receiver.

SUMMARY OF THE INVENTION

An objection of the present invention may resolve this drawback, by allowing the connection of an antenna to a dual-band receiver, while limiting the bulk of the connection means.

The present invention provides an antenna interface for a radio receiver, of the type comprising a socket, designed to be connected to the receiver, and a plug, designed to be connected to the antenna, characterized in that:

- the socket comprises a body and two coaxial cables, each comprising a core, a braid coaxial to the core, and an electric insulator between the core and the braid so as to electrically insulate them,
- each coaxial cable extends between a first end connected to a printed circuit board of the receiver and a second end at which the braid is electrically connected to the body, and at which the core can be accessed through a respective opening made in the body of the socket,
- the plug comprises a body and at least two piston contactors, such that, when the plug and the socket are connected, each contactor is arranged opposite an opening such that the core of a respective cable is electrically connected to said contactor, and the braid of each cable is electrically connected to the body of the plug via the body of the socket,
- each piston contactor comprises a stationary portion, to be connected to a printed circuit board of the antenna, and a moving portion relative to the stationary portion, including a contact element designed to cooperate with a respective core when the socket is connected with the plug, and
- the plug comprises a flexible membrane, supporting the contact elements of the piston contactors.

Unlike a traditional antenna interface, the interface according to the invention has two hot spots (formed by the contactors, to which the cores of the cables are connected) and a ground reference (formed by the body of the plug, to which the braids of the cables are connected). In this way, this interface makes it possible to work on two distinct frequencies, to transmit and/or receive from the station on those two frequency bands. The interface according to the invention is therefore particularly suitable for connecting an antenna to a dual-band receiver.

According to the present invention, the connection of the antenna to the dual-band receiver is done using a single interface. However, a single interface may be less bulky and expensive than the two interfaces necessary in the state of the art.

Furthermore, the present invention allows the use of a single collinear antenna, which allows the transmission and/or reception by the receiver on both frequency bands simultaneously, which was not possible in the state of the art. In fact, in the state of the art, the use of two sockets involves the use of two respective antennas, each transmitting in a frequency band, each antenna risking scrambling the other antenna's signal.

Furthermore, it will be noted that the interface according to the present invention is suitable for use in an aggressive environment, for example in a humid environment. In fact, the membrane performs a sealing function, in particular protecting the connectors and cables from moisture.

The interface according to the present invention may also comprise one or more of the following features, considered alone or according to all technically possible combinations:

- for each piston contactor, the stationary portion comprises an electrically insulating hollow cylindrical element, forming a piston body in which the moving part can move axially, and the contact element of the moving part comprises a first guide portion, and a second contact portion designed to cooperate with a respective core when the socket is connected to the plug, and the first guide portion is generally cylindrical, with a diameter substantially equal to an inner diameter of a hollow cylindrical element, so as to cooperate without play with an inner wall of said hollow cylindrical element,
- the socket comprises a bottom wall in which the openings are formed, the plug comprises an end-of-travel stop against which the bottom wall abuts when the socket is connected to the plug, and the end-of-travel stop being provided such that a free space remains between the membrane and the bottom wall when the socket is connected with the plug,
- each piston contactor, in particular the hollow cylindrical element, is sized so as to minimize the cross-talk between the signals passing through said piston contactors, preferably for a cross-talk of less than 45 dB,
- the socket comprises a first portion, preferably threaded so as to be screwed into a complementary opening of the receiver or screwed to a locknut, and a second threaded portion, designed to be screwed in a complementary housing of the plug, the first and second threaded portions being axially separated by a flange,
- the flange bears, on the side of the first portion, a sealing ring designed to cooperate with the contour of the complementary opening of the receiver,
- the body of the plug generally has a shape of revolution around an axis, the plug comprising a knob freely rotating around the axis relative to the body, the knob having a generally hollow cylindrical shape, inwardly tapped, delimiting the complementary housing of the second threaded portion of the socket,
- the interface comprises a sealing ring, arranged in the housing of the knob, between the body and the knob,
- the socket and the plug comprise complementary means forming a mistake-proofing device, designed to ensure that the contactors cooperate with a respective core when the plug and socket are connected.

BRIEF DESCRIPTION OF THE DRAWINGS

The invention will be better understood upon reading the following description, provided solely as an example and done in reference to the appended figures, in which.

DETAILED DESCRIPTION

Figure 1:
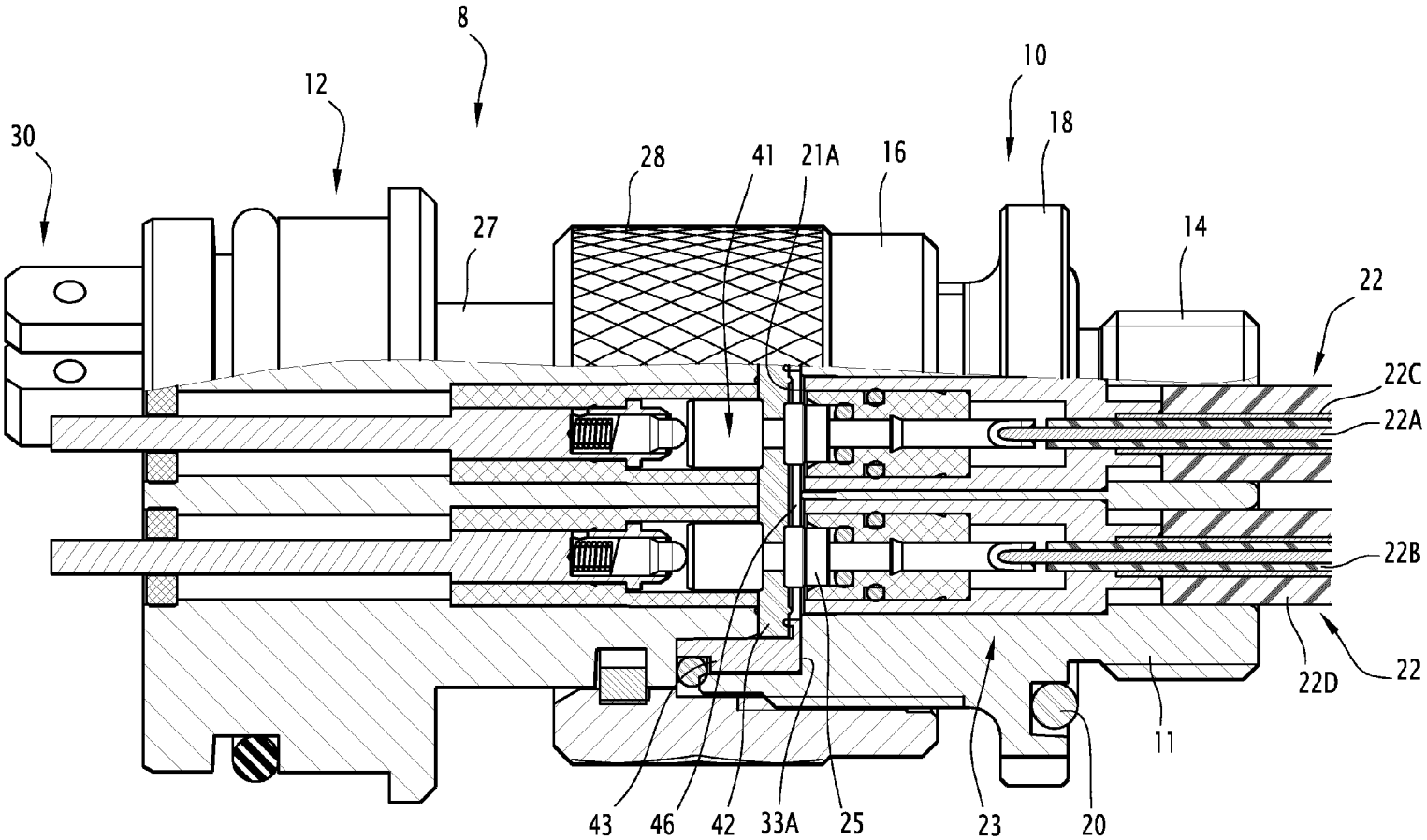
FIG. 1 is a partial axial side view of an antenna interface according to one example embodiment of the invention.

FIG. 1 shows an antenna interface 8 according to one example embodiment of the invention. Such an interface 8 is in particular designed to equip a radio receiver, for example a dual-band tactical radio receiver, to connect a dual-band antenna.

Figure 2:
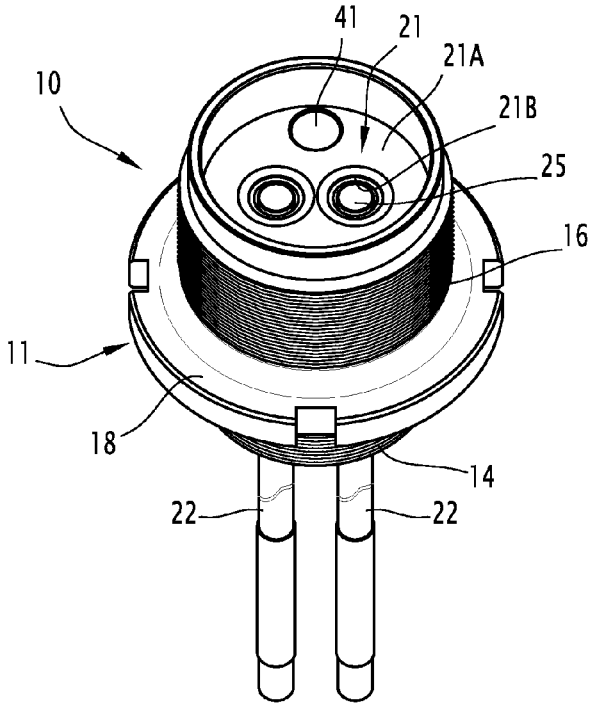
FIG. 2 is a perspective view of a socket of the antenna interface of FIG. 1.
Figure 3:
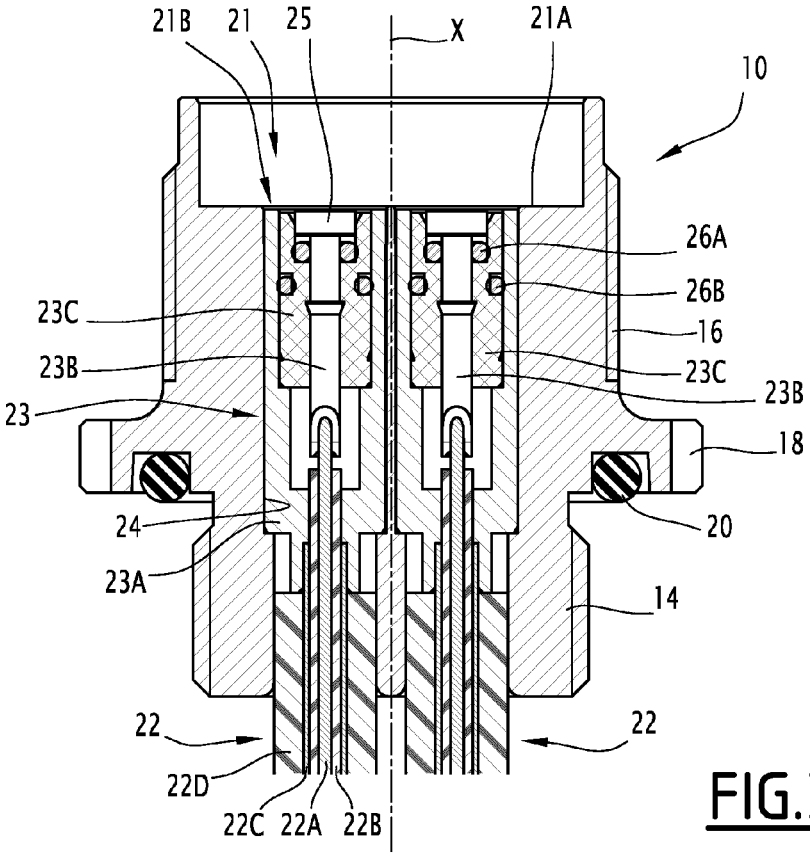
FIG. 3 is an elevation view of the socket of FIG. 2.
Figure 4:
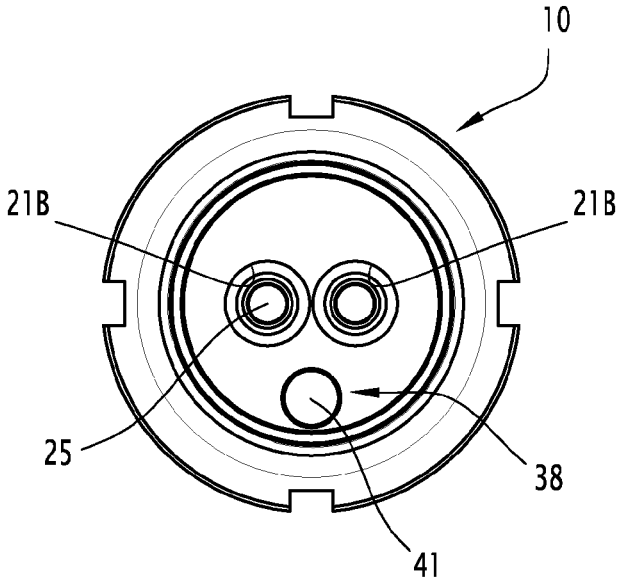
FIG. 4 is a transverse cross-sectional view of the socket FIG. 1.
Figure 5:
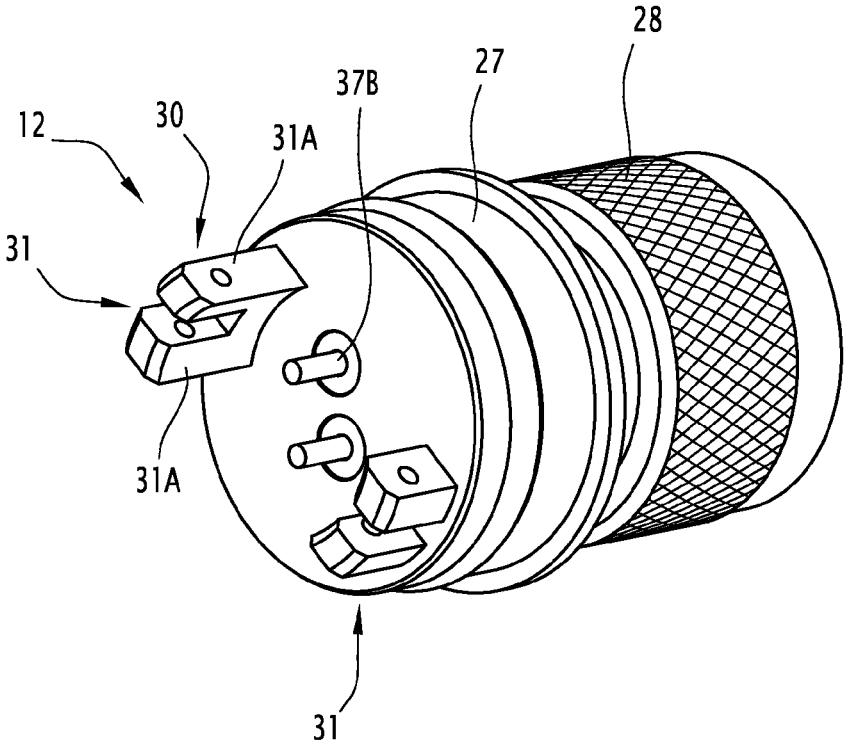
FIG. 5 is a perspective view of the plug of the interface of FIG. 1.
Figure 6:
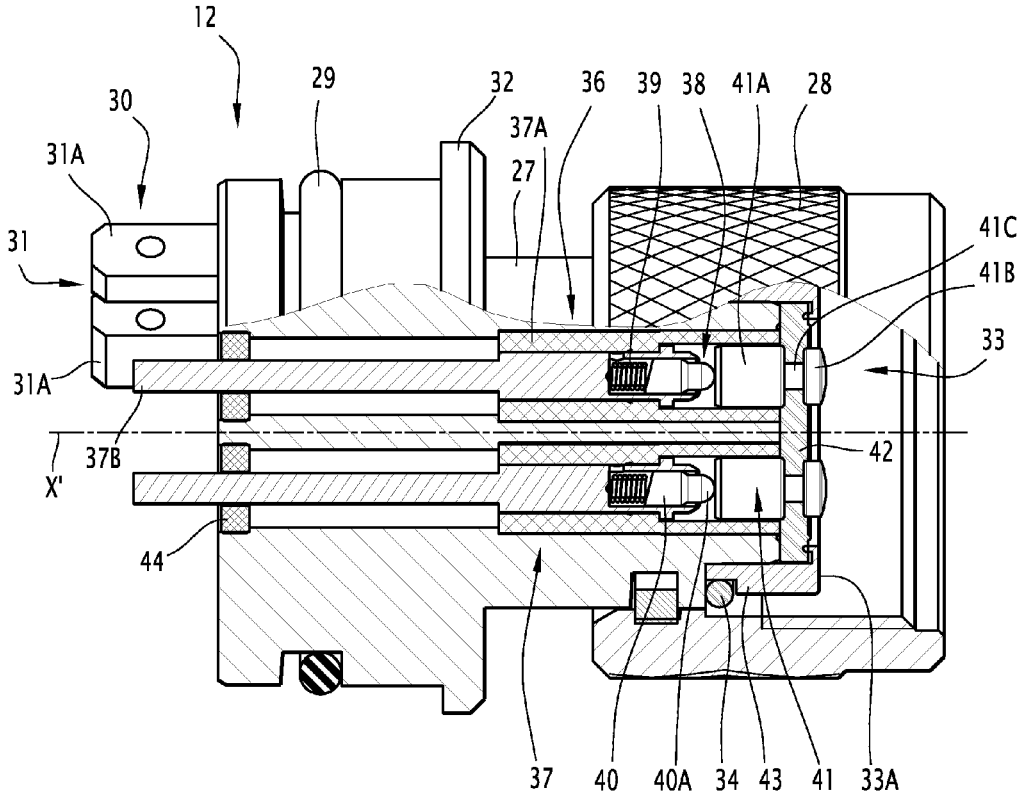
FIG. 6 is a partial axial cross-sectional view of the plug of FIG. 5.
Figure 7:
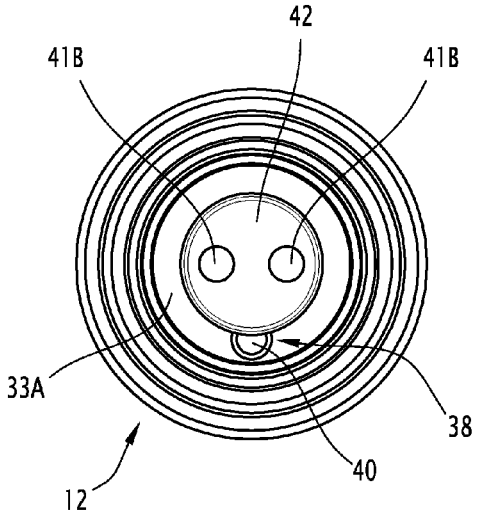
FIG. 7 is a transverse cross-sectional view of the plug of FIG. 5.

The interface 8 comprises a socket 10, in particular shown in FIGS. 2 to 4, and a plug 12, in particular shown in FIGS. 5 to 7, designed to cooperate with the socket 10 so as to form the interface 8 as shown in FIG. 1.

The socket 10 comprises a body 11, with a general shape of revolution around an axis X. This body 11 comprises a first portion 14 and a second portion 16, which are substantially cylindrical, and a flange 18 axially separating the first 14 and second 16 portions.

The first portion 14 has a threaded outer surface, designed to be screwed into a complementary opening of the radio receiver. The flange 18 then in particular forms an end-of-travel stop for said screwing.

It will be noted that the threaded outer surface forms particularly compact fastening means for fastening to the radio receiver, with a reduced axial bulk and that are sufficiently robust.

Advantageously, a sealing ring 20, visible in FIG. 3, is borne by the flange 18. Such a sealing ring 20 is designed to cooperate with the contour of the complementary opening of the receiver, so as to ensure sealing of the receiver.

Alternatively, the first portion 14 could comprise any other means for fastening to the radio receiver. For example, said first portion 14 could be threaded only over an area designed to be screwed into a locknut. The first portion 14 could also not be threaded, but designed to be forcibly entered into a complementary opening of the receiver.

The second portion 16 also has a threaded outer surface. Preferably, the second portion 16 has a diameter larger than the diameter of the first portion 14.

Advantageously, the diameter of the socket 10, in particular the diameter of the flange 18, is smaller than 2 cm. In other words, the socket 10 is smaller than a socket of a traditional interface.

The second portion 16 comprises an axial cavity 21, axially delimited by a bottom wall 21A.

The socket 10 also comprises at least two distinct coaxial cables 22, designed to be connected to a radio card of the receiver. In this way, said socket allows direct mechanical interfacing with said radio card.

A coaxial cable 22 is shown in more detail in FIG. 1. Traditionally, each coaxial cable 22 comprises a central conducting core 22A, surrounded by an electrically insulating material 22B, which in turn is surrounded by a conductive braid 22C, positioned coaxially to the core. The braid 22C is lastly surrounded by an insulating sheath 22D, preferably fastened to the socket 10.

Each cable 22 comprises a first end, which extends axially outside the socket 10, beyond the first portion 14, and comprising a traditional connector designed to be connected to the radio card of the receiver. Each cable 22 also comprises a second end, opposite the first, extending through the socket 10 as far as the bottom wall 21A.

The second end of each cable 22 is connected to the socket 10 using a connecting element 23, described in reference to FIG. 1.

The connecting element 23 comprises a first conductive portion 23A in the form of a sleeve, designed to cooperate with the braid 22C of a respective cable 22, said first portion 23A being housed without play in a through opening 24 of the body 11 of the socket 10. In this way, the braid 22C is electrically connected to the body 11 by means of said first portion 23A of the connecting element 23.

The connecting element 23 also comprises a second conductive portion 23B, designed to cooperate with the core 22A of the corresponding cable 22. For example, the core 22A is inserted into a longitudinal opening of the second portion 23B. Preferably, the second portion 23B comprises a contact plate 25.

The connecting element 23 lastly comprises an electrical insulator 23C, inserted radially between the first 23A and second 23B conductive portions so as to electrically insulate them relative to one another.

Advantageously, the O-ring seals 26A, 26B are inserted radially between the first conductive portion 23A and the insulator 23C, and between the insulator 23C and the second conductive portion 23B, respectively.

The bottom wall 21A comprises at least two openings 21B, through which the contact plates 25 are respectively accessible.

The plug 12, shown in more detail in FIGS. 5 to 7, also has a general shape of revolution around an axis X', and comprises a body 27 and a knob 28 freely rotating around the axis X' relative to the body 27.

The body 27 bears, on the outer surface thereof, means 30 for connecting on an antenna, in particular a traditional collinear antenna.

The connecting means 30 for example comprise two pairs 31 of fastening fingers 31A, the pairs 31 being arranged diametrically opposite one another. The fastening fingers 31A of each pair 31 are spaced relative to one another suitably to receive a printed circuit board of the collinear antenna between those fingers 31A.

Preferably, the fastening fingers 31A are suitable for allowing welding of the printed circuit board on said fingers 31A. In fact, the welding may allow robust and electrically conductive fastening.

Advantageously, the fastening fingers 31A are integral with the body 27 of the plug 12. Alternatively, said fingers 31A may be fastened on the body 27, in particular in the case where the material from which the fingers 31A are made is better suited to welding the material from which the body 27 is made.

Furthermore, the body 27 bears an O-ring seal 29 and a flange 30. In this way, the body 27 is adapted to receive a sleeve of the antenna, the body 27 being fitted into that sleeve as far as the flange 32, the sealing device 29 then cooperating with the sleeve.

The knob 28 forms a sleeve, with a generally hollow cylindrical shape, delimiting a housing 33, with a tapped inner wall complementary with the second threaded portion 16 of the socket 10. In this way, the connection of the socket 10 with the plug 12 is done by inserting the second threaded portion 16 into the housing 33, then rotating the knob 28, so as to screw said knob 28 on the second portion 16, until the bottom wall 21A of the base 10 cooperates with an end-of-travel stop 33A provided in the housing 33.

Preferably, a sealing ring 34 is arranged in the housing 33, between the inner wall of the housing 33 and the body 27, so as to ensure sealing of the connection between the socket 10 and the plug 12.

The plug 12 also comprises at least two contactors 36, borne by the body 27 of said plug 12. When the plug 12 is connected with the socket 10, each contactor 36 cooperates with the plate 25 connected to the core 22A of a respective cable 22, accessible through the respective opening 21B of the bottom wall 21A. Furthermore, the braids 22C of the cables 22 cooperate with the body 27 of the plug 12, by means of the body 11 of the socket. In other words, the contactors 36 form two hot spots of the antenna, while the body 27 of the plug 12 forms the ground reference.

Preferably, the socket 10 and the plug 12 comprise complementary means 38 forming a safety device, designed to ensure that each contactor 36 cooperates with the respective plate 25 when the plug 12 and the socket 10 are connected.

For example, the means 38 comprise a projection 40 supported by the plug 12 (shown in FIG. 7), and a complementary cavity 41 formed in the bottom wall 21A of the socket 10 (shown in FIG. 4). In this way, the projection 40 is protected by the knob 28, the height of which provides easy access to that projection 40 for elements of a nature to damage it. However, the projection may alternatively be supported by the socket 10, and the complementary cavity formed in the plug 12. Other safety means may also be provided.

Advantageously, at least one contactor 36, preferably each contactor 36, is a piston contactor comprising a stationary portion 37 and a moving portion 38 relative to the stationary portion 37, as well as an elastic member 39, for example a spring, arranged between the stationary portion 37 and the moving portion 38 to return the moving portion 38 toward an idle position.

The stationary portion 37 comprises an electrically insulating hollow cylindrical element 37A forming a piston body in which the moving portion 38 is designed to move axially. The stationary portion 38 also comprises a conductive longitudinal element 37B, extending longitudinally between a first end, forming a first seat for the elastic member 39, and a second end, extending outside the body 27, designed to be connected to the printed circuit board of the antenna.

Preferably, the body 27 bears annular insulating support elements 44, each annular insulating element 44 bearing the second end of a respective longitudinal conductive element 37A. These annular elements 44 are designed to keep the second ends in a specific position, so as to ensure the proper connection of these second ends with the printed circuit board of the antenna. Furthermore, these annular elements 44, by maintaining the second ends, participate in the proper durability of the plug 12. For example, these insulating annular elements 44 are made from Teflon®.

According to the described embodiment, the moving portion 38 comprises a thrust element 40, forming a second seat of the elastic member 39, and a contact element 41, designed to cooperate with a respective plate 25 when the socket 10 is connected with the plug 12.

The contact element 41 comprises a first guide portion 41A and a second contact portion 41B.

The first portion 41A has a generally cylindrical shape, with a diameter substantially equal to an inner diameter of the hollow cylindrical element 37A forming a piston body, so as to cooperate without play with an inner wall of that hollow cylindrical element 37A. In this way, this first portion 41A can axially guide the moving portion 38 when it slides in the hollow cylindrical element 37A, by ensuring that that moving portion 38 does not become radially offset. It thus in particular ensures proper alignment between the thrust element 38 and the contact element 41.

The first portion 41A has a surface, preferably planar, cooperating with the thrust element 40. To that end, the thrust element 40 has a head 40A, designed to cooperate with said planar surface. Preferably, the head 40A has a generally rounded shape, so as to ensure optimal contact with the planar surface of the first portion 41A.

The second contact portion 41B forms a head of the contact element 41, designed to cooperate with a respective plate 25 when the socket 10 is connected with the plug 12. Preferably, the second contact portion 41B has a generally rounded shape, so as to ensure optimal contact with the plate 25.

The plug 12 also comprises a sealing membrane 42, fastened to the body 27 using a fastening washer 43.

The sealing membrane 42 has two through openings, through which a respective contact element 41 passes. Thus, the first portion 41A of a contact element 41 is positioned on one side of the membrane 42, and the second contact portion 41B is arranged on the other side of the membrane 42, so as to be accessible to the contact of a plate 25, the first 41A and second 41B portions being connected by a connection portion 41C with a diameter substantially equal to that of the corresponding opening.

The membrane 42 is relatively flexible, so as to allow the movement of the moving portion 38. For example, the membrane 42 is made from an elastomer, preferably fluorinated silicone.

It will be noted that the fastening washer 43 extends axially beyond the membrane 42, so as to support the end-of-travel stop 33A. Thus, when the socket 10 is connected to the plug 12, a free space 46 remains between the membrane 42 and the bottom wall 21A. This free space 46 in particular allows a free deformation of the membrane 42, so as not to block any movements of the moving parts 38.

Such a piston contactor 36 can adapt simply and effectively to its environment, since the position of the moving portion 38 is variable. Thus, the piston contactors in particular allow flexible and simple fastening of the socket 10 to the plug 12, for example by taking up play or alignment flaws. Such piston contactors 36 are particularly compact, which makes it possible to produce a smaller interface.

Furthermore, these piston contactors 36 allow effective separation of the two bands. Thus, the interface according to the invention in particular allows the radio receiver to transmit and/or receive on two bands simultaneously.

In fact, each piston contactor is sized so as to minimize coupling between the two bands, such that the signal on one channel does not disrupt the signal on the other channel. In other words, each piston contactor is sized so as to minimize the cross-talk (i.e. the parasitic superposition of one signal on another) between signals crossing through said piston contactors, preferably for a cross-talk of less than 45 dB.

In particular, the dimensions of the electrically insulating hollow cylindrical element 37A are chosen so as to maximize the resistance of that cylindrical element to wave losses, said resistance being expressed in the form:

$$R = \frac{60}{\sqrt{\varepsilon_r}} \cdot \ln \frac{Dext}{Dint},$$

where

R is the resistance of the insulating element 37A against wave losses, $\epsilon_r$ is the relative permittivity of the material from which the insulating element 37A is made, Dext is the outer diameter of the insulating element 37A, and Dint is the inner diameter of the insulating element 37A.

The inner and outer diameters of the insulating element 37A are then generally determined using simulations making it possible to estimate the optimal values.

Furthermore, the ratio of the diameter of the membrane 42 to the diameter of a second contact portion 41B is also estimated so as to optimize the separation between the two channels.

It will be noted that the interface according to the invention has optimal sealing and good robustness. Such an interface may in particular be used in an aggressive environment.

Furthermore, the production cost of such an interface is relatively low, in particular lower than the production cost of the two interfaces of the state of the art needed to produce a traditional connection of a dual-band radio with an antenna.

It will be noted that the invention is not limited to the embodiment previously described, but could assume various alternatives without going beyond the scope of the claims.

In particular, the socket 10 could comprise various fastening means on the receiver, and the plug 12 could comprise various connecting means on an antenna.

According to another alternative, the plug 12 could comprise two distinct sealing membranes 42, each bearing a respective moving contact element 41.

According to another alternative, the interface could comprise more than two coaxial cables and corresponding contactors, so as to allow transmission and/or reception on more than two radiofrequency bands.

What is claimed is:

1. An antenna interface for a radio receiver comprising:

a socket, designed to be connected to the receiver, the socket including:

a body; and two coaxial cables, each coaxial cable including a core, a conductive braid coaxial to the core, and an electric insulator between the core and the braid, each coaxial cable extending between a first end and a second end, the first end being connectable to a first printed circuit board of the receiver, the second end electrically connecting the braid to the body of the socket, at the second end the core can be accessed through a respective opening made in the body of the socket; and the antenna interface also including, a plug, designed to be connected to the antenna, the plug including:

a body, at least two piston contactors, each piston contactor including a stationary portion connectable to a second printed circuit board of the antenna, and a moving portion relative to the stationary portion, the moving portion including a contact element designed to cooperate with a respective core when the socket is connected with the plug, and a flexible membrane, supporting the contact elements of the at least two piston contactors, wherein when the plug and the socket are connected, each contactor is arranged opposite an opening such that the core of a respective cable is electrically connected to the contactor, and the braid of each cable is electrically connected to the body of the plug via the body of the socket.

2. The antenna interface according to claim 1, wherein, for each piston contactor:

the stationary portion includes an electrically insulating hollow cylindrical element, forming a piston body in which the moving part can move axially, the contact element of the moving part includes a first guide portion, and a second contact portion designed to cooperate with a respective core when the socket is connected to the plug, and the first guide portion is cylindrical, with a diameter substantially equal to an inner diameter of the hollow cylindrical element, so as to cooperate without play with an inner wall of the hollow cylindrical element.

3. The antenna interface according to claim 2, wherein:

the socket includes a bottom wall in which the openings are formed, the plug includes an end-of-travel stop against which the bottom wall abuts when the socket is connected to the plug, and the end-of-travel stop being arranged so a free space remains between the membrane and the bottom wall when the socket is connected with the plug.

4. The interface according to claim 2, wherein each piston contactor is sized so as to minimize cross-talk between signals passing through the piston contactors.

5. The antenna interface according to claim 1, wherein the socket includes a first threaded portion so as to be screwed into a complementary opening of the receiver or screwed to a locknut, and a second threaded portion, designed to be screwed in a complementary housing of the plug, the first and second threaded portions being axially separated by a flange.

6. The antenna interface according to claim 5, wherein the flange bears, on a side of the first portion, a sealing ring designed to cooperate with a contour of a complementary opening of the receiver.

7. The antenna interface according to claim 5, wherein the body of the plug has a shape of concentric around an axis, the plug including a knob freely rotating around the axis relative to the body, the knob having a hollow cylindrical shape, inwardly tapped, delimiting a complementary housing for the second threaded portion of the socket.

8. The antenna interface according to claim 7, comprising a sealing ring, arranged in a housing of the knob, between the body and the knob.

9. The antenna interface according to claim 1, wherein the socket and the plug include a mistake-proofing device, designed to ensure that the contactors cooperate with a respective core when the plug and socket are connected.

10. The antenna interface as recited in claim 4 wherein the hollow cylindrical element of the piston contactor is sized to minimize cross-talk between signals.

11. The antenna interface as recited in claim 4 wherein the cross-talk is minimized to less than 45 dB.

12. The antenna interface as recited in claim 10 herein the cross-talk is minimized to less than 45 dB.

* * * * *